US009212464B2

(12) United States Patent
Sasaki

(10) Patent No.: US 9,212,464 B2
(45) Date of Patent: Dec. 15, 2015

(54) CONSTRUCTION MACHINE

(71) Applicant: KOBELCO CONSTRUCTION MACHINERY CO., LTD., Hiroshima-shi (JP)

(72) Inventor: Hirofumi Sasaki, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/494,792

(22) Filed: Sep. 24, 2014

(65) Prior Publication Data

US 2015/0115660 A1 Apr. 30, 2015

(30) Foreign Application Priority Data

Oct. 31, 2013 (JP) ..... 2013-226565

(51) Int. Cl.
*E02F 9/16* (2006.01)
*E02F 9/08* (2006.01)
*E02F 3/32* (2006.01)

(52) U.S. Cl.
CPC ..... *E02F 9/0833* (2013.01); *E02F 3/325* (2013.01); *E02F 9/0858* (2013.01); *E02F 9/16* (2013.01)

(58) Field of Classification Search
CPC ..... E02F 3/325; E02F 9/0833; E02F 9/0858; E02F 9/16
USPC ..... 296/190.08; 180/89.12, 89.18
See application file for complete search history.

(56) References Cited

U.S. PATENT DOCUMENTS

2008/0035401 A1 2/2008 Ishii et al.
2014/0124280 A1* 5/2014 Kimura et al. ..... 180/89.12
2014/0232130 A1* 8/2014 Tanaka et al. ..... 296/24.3

(Continued)

FOREIGN PATENT DOCUMENTS

JP 2000-96609 4/2000
JP 2002-242225 8/2002

(Continued)

OTHER PUBLICATIONS

Extended Search Report issued Mar. 12, 2015 in European Patent Application No. 14186748.1.

*Primary Examiner* — Jason S Morrow
(74) *Attorney, Agent, or Firm* — Oblon, McClelland, Maier & Neustadt, L.L.P.

(57) ABSTRACT

Provided is a construction machine capable of easy removal of an electric-component box for maintenance of a maintenance-requirement device, including a seat stand, a partition wall provided in an under-seat space under the seat stand to define a front space, an electric-component box installed in the front space, a maintenance-requirement device rearward of the front space, and a harness connecting an electric component in the electric-component box to an external device and including a downward-extending portion extending downward from the height of a wiring port in the seat stand and an upward-extending portion extending upward from the height of a lower end of the downward-extending portion, thus routed in a devious path including allowance for allowing removal of the electric-component box between a position for closing a rear opening in the partition wall and a position for allowing maintenance work for the maintenance-requirement device through the rear opening.

2 Claims, 6 Drawing Sheets

(56) References Cited

U.S. PATENT DOCUMENTS

| | | | | |
|---|---|---|---|---|
| 2015/0115657 | A1* | 4/2015 | Hiraoka et al. | 296/190.01 |
| 2015/0125248 | A1* | 5/2015 | Sasaki | 414/744.2 |

FOREIGN PATENT DOCUMENTS

| | | |
|---|---|---|
| JP | 2003-13469 | 1/2003 |
| JP | 2006-97314 | 4/2006 |

* cited by examiner

CONSTRUCTION MACHINE

TECHNICAL FIELD

The present invention relates to a construction machine, such as an excavator, which includes an operator's seat, an electric component installed in an under-seat space located under the operator's seat, an external device, and a harness which interconnects the electric component and the external device.

BACKGROUND ART

Background art for the present invention will be described taking a small-sized excavator depicted in FIG. 6 as an example.

The excavator includes a crawler-type lower travelling body 1, an upper slewing body 2 mounted on the lower travelling body 1 so as to be able to be slewed around an axis X perpendicular to the ground, and a working attachment AT attached to a front portion of the upper slewing body 2. The working attachment AT includes: a boom 3; an arm 4; a bucket 5; and respective hydraulic actuators which actuate the boom 3, the arm 4, the bucket 5, namely, a boom cylinder 6, an arm cylinder 7, and a bucket cylinder 8.

The upper slewing body 2 includes an upper frame 9, on which a seat stand 10, an operator's seat 11 provided on the seat stand 10, a canopy 12 which covers the operator's seat 11 at the upper side thereof, various operation devices, an engine and equipment related to the engine. There is another specification including, instead of the canopy 12, a cabin in which the seat stand 10 and the operator's seat 11 are installed, namely, a cabin specification.

As shown in FIG. 7, the upper frame 9 includes a bottom plate 13 and a floor plate 14 disposed above the bottom plate 13 at a vertical interval. Between the bottom plate 13 and the floor plate 14 is defined an underfloor space S1, in which a control valve unit and the like are installed.

"Front and rear" and "right and left" used herein refer to directions as viewed from an operator seated in the operator's seat 11.

The seat stand 10 is installed on the upper frame 9 at a position rearward of the floor plate 14, defining an under-seat space S2 under the operator's seat 11, between the seat stand 10 and the bottom plate 13 of the upper frame 9.

The upper slewing body 2 further includes a partition wall 15 and a separation wall 17. The partition wall 15 is vertically provided in an upper portion of the under-seat space S2 to define a front space 16, a front part of the under-seat space S2, above the floor plate 14. In the under-seat space S2, the space except the front space 16 constitutes an engine room.

The separation wall 17 is vertically provided to partition a lower portion of the under-seat space S2 and the underfloor space S1 forward thereof.

The excavator further includes an electric-component box 19 and a box stand 20 which are accommodated in the front space 16. The electric-component box 19 accommodates a lot of electric components 18 including a relay. For simplification of drawing, only one electric component 18 is depicted in FIG. 7 and FIG. 9, and only three electric components 18 are depicted in FIG. 8. The electric-component box 19 is vertically and detachably installed, while placed on the box stand 20, by bolting or the like.

The electric-component box 19 is a rectangular parallelepiped-like box, having a box-opening 19*a* opened forward. The seat stand 10 has a front wall 10*a* formed with a front opening 21 overlapping the box-opening 19*a*. The openings

21 and 19*a* allows work such as attachment and wiring of the electric components 18 to be performed at a front side of the seat stand 10 through the openings 21 and 19*a*.

The partition wall 15 has a rear opening 22 which brings respective spaces forward and rearward of the partition wall 15 into communication with each other. The rear opening 22 allows maintenance work to be performed on a part of devices 23 located rearward of the front space 16 in the under-seat space S2, for example, an alternator and a stator motor, through the rear opening 22.

The excavator further includes a front cover 24 which closes the front opening 21 at a front side thereof and a rear cover 25 which closes the rear opening 22 at a front side thereof. The covers 24 and 25 are detachably attached to the seat stand 10 and the partition wall 15, respectively, with not-graphically-shown bolts or the like. FIG. 8 shows a state where the front cover 24 has been detached.

The excavator further includes a harness 26. The harness 26 is a wire bundle for interconnecting the electric components 18 in the electric-component box 19 and external devices outside the electric-component box 19, for example, a relay and a controller that controls the relay. The harness 26 includes: a first portion extending from the outside of the seat stand 10 to an upper right portion of the front space 16 through a wiring port 27 formed in a right sidewall 10*b* of the seat stand 10 or the like; a second portion located over the electric-component box 19 in the front space 16 and extending horizontally from the first portion to a laterally intermediate portion of the electric-component box 19; and a third portion extending vertically downward from the second portion in a frontal area in the electric-component box 19 to be connected to the electric components 18. In the front space 16, the harness 26 is fixed to the electric-component box 19 in an appropriate region with a clip 28. The harness 26 is, thus, routed in the approximately shortest path downward from the wiring port 27.

There is disclosed a technique for installing the electric components in the under-seat space in Japanese Patent Application Laid-open No. 2000-96609, Japanese Patent Application Laid-open No. 2002-242225, and Japanese Patent Application Laid-open No. 2003-13469.

Rearward of the front space 16 in the under-seat space S2, disposed is a maintenance-requirement device 23 which requires its maintenance. Maintenance work for the maintenance-requirement device 23 is performed at the front side of the seat stand 10 in a state where the front and rear openings 21, 22 are opened by respective detachments of the front and rear covers 24 and 25. Meanwhile, the electric-component box 19 closing the rear opening 22 obstructs the detachment of the rear cover 25 and the maintenance work; hence the electric-component box 19 has to be removed, at the minimum, to a position which allows a space and operator's vision for the work to be secured, desirably, to a position outside the front space 16. However, the harness 26, being routed in the approximately shortest path from the wiring port 27 to the electric components 18 with little allowance, prevents the electric-component box 19 from being removed along with the harness 26. The harness 26, therefore, has to be temporarily disconnected from the electric components 18 during maintenance work for the maintenance-requirement device 23 in order to allow the electric-component box 19 to be removed. This significantly degrades the efficiency in the maintenance work including subsequent restoration.

Besides, the harness 26, routed to the electric components 18 in the vertically shortest path, can allow water having infiltrated into the front space 16 due to damage to a sealing member or degradation thereof, for example, rainwater and cleaning water, to run down along the harness 26 to reach the electric components 18, thereby generating a possibility of malfunctioning or failure of the electric components 18.

SUMMARY OF INVENTION

An object of the present invention is to provide a construction machine including an electric-component box and a harness connected to the electric-component box, the control machine allowing the electric-component box to be easily removed to a position where the electric-component box does not hinder maintenance for a maintenance-requirement device and preventing water from reaching electric components.

Provided by the present invention is a construction machine including: a lower travelling body; an upper slewing body mounted on the lower travelling body so as to be slewable, the upper slewing body including an upper frame including a bottom plate and a floor plate provided above the bottom plate at a vertical interval, a seat stand provided rearward of the floor plate and on the upper frame and defining an under-seat space between the seat stand and the bottom plate of the upper frame, an operator's seat provided on the seat stand, and a partition wall provided in a front portion of the under-seat space to define a front space at a front side of the partition wall; an electric-component box installed in the front space to accommodate an electric component; a maintenance-requirement device requiring maintenance and installed in a space which is included in the under-seat space and located at a rear side of the front space; and a harness for connecting the electric component in the electric-component box to an external device located outside the under-seat space. The seat stand includes a front wall located forward of the front space, the front wall including a front opening which brings an outer space forward of the front wall and the front space rearward of the front wall into communication with each other. The partition wall includes a rear opening which brings the front space forward of the partition wall and the under-seat space rearward of the partition wall into communication with each other. The seat stand includes a wiring port for introducing the harness into the front space through the wiring port. The harness includes a region to be routed in the front space, the region including a downward-extending portion extending downward from a height of the wiring port to a lower portion of the front space and an upward-extending portion extending upward from a first height position equivalent to a height position of a lower end of the downward-extending portion to a second height position which allows the harness to be connected to the electric component; the region is thus routed in a devious path having a routing length larger than a length of the shortest path from the wiring port to the electric component, the routing length including allowance enough to allow the electric-component box to be removed, while remaining connected to the harness, between a first position where the electric-component box closes the rear opening at a front side of the rear opening and a second position where the electric-component box allows maintenance work for the maintenance-requirement device to be performed through the front opening and the rear opening.

DESCRIPTION OF EMBODIMENTS

An embodiment of the present invention will be described with reference to FIGS. 1 to 5.

Figure 6:
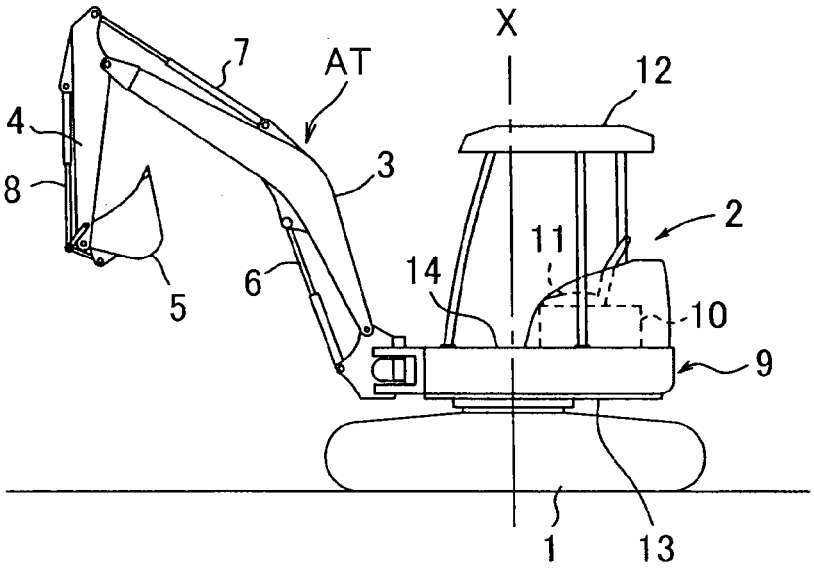
FIG. 6 is a schematic side view of a small-sized excavator, an example of a construction machine to which the present invention is applied.
Figure 7:
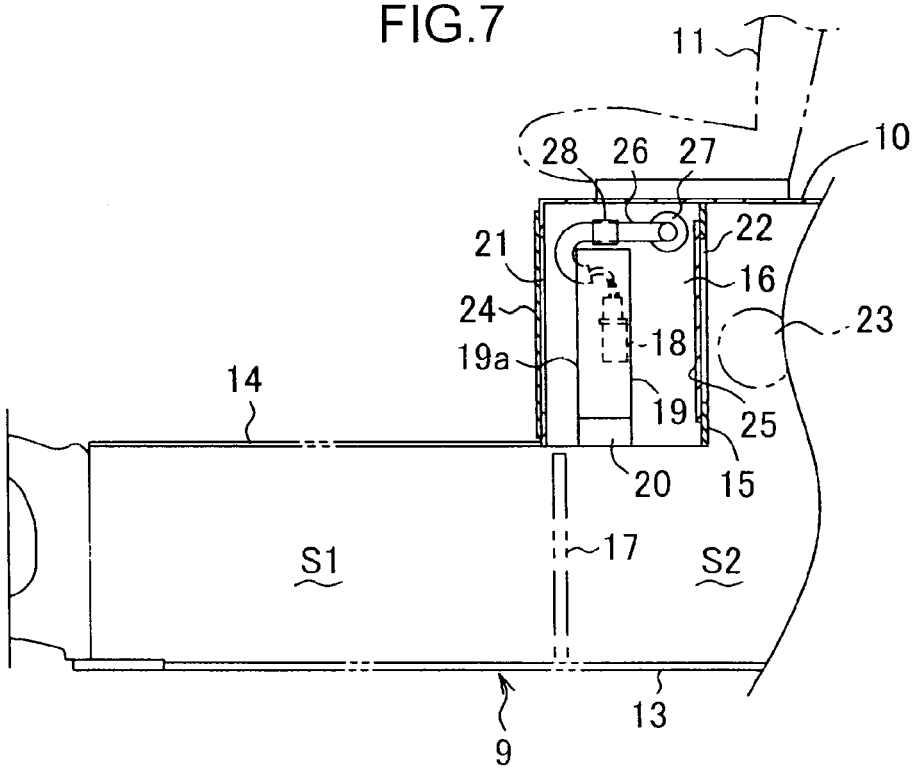
PRIOR ART FIG.7
FIG. 7 is a cross-sectional side view of the structure inside a seat stand in a conventional small-sized excavator.
Figure 8:
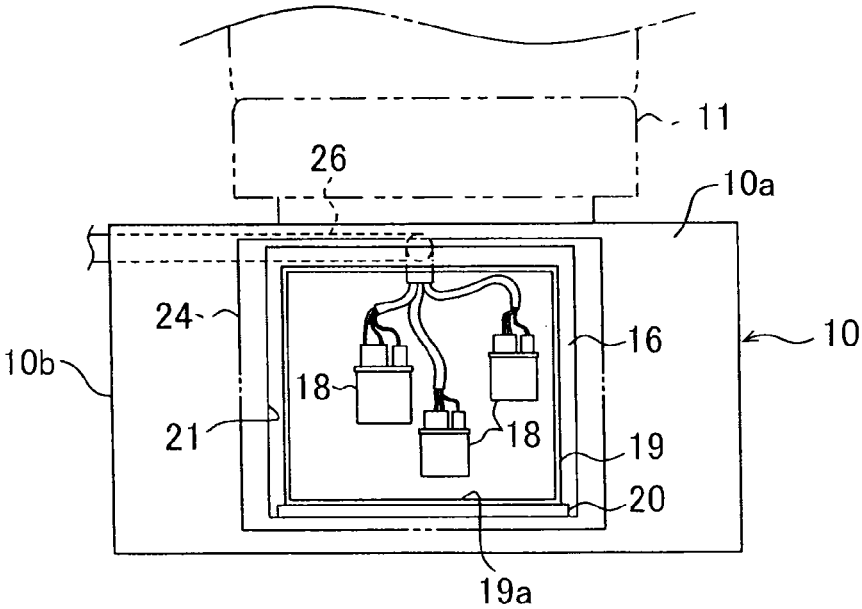
PRIOR ART FIG.8
FIG. 8 is a front view of a structure shown in FIG. 7.
Figure 9:
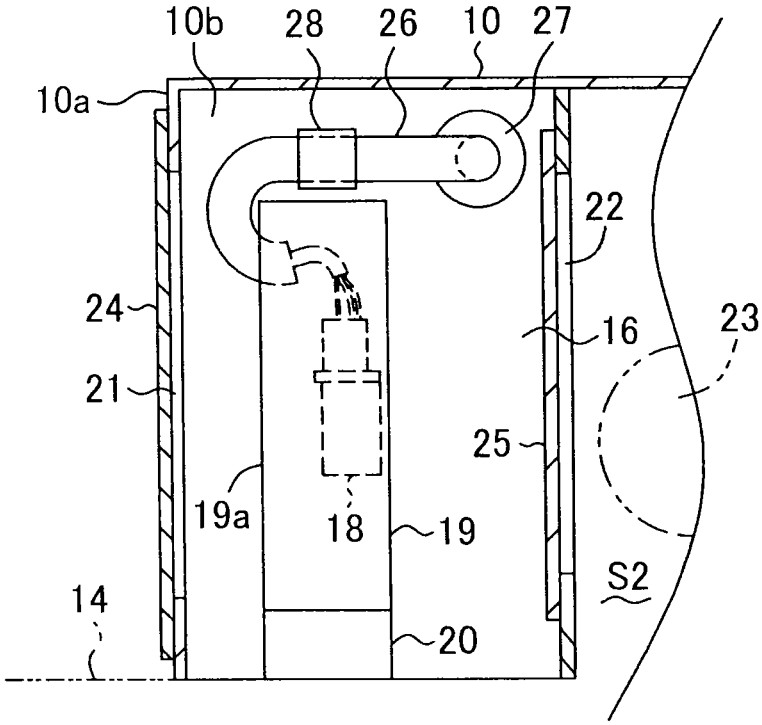
PRIOR ART FIG.9
FIG. 9 is a cross-sectional view showing an enlarged part of FIG. 7.

The embodiment is an example of applying the present invention to an excavator shown in FIG. 6.

Specifically, the excavator according to the embodiment includes: a crawler type of lower travelling body 1; an upper slewing body 2 mounted on the lower travelling body 1 so as to be slewable around an axis X perpendicular to the ground, and a working attachment AT attached to a front portion of the upper slewing body 2. The working attachment AT includes a boom 3, an arm 4, a bucket 5, and respective hydraulic actuators for actuating the boom 3, the arm 4, and the bucket 5, namely, a boom cylinder 6, an arm cylinder 7, and a bucket cylinder 8.

The upper slewing body 2 has an upper frame 9, on which a seat stand 10, an operator's seat 11 provided on the seat stand 10, a canopy 12 which covers the operator's seat 11 at an upper side thereof, various operation devices, an engine and related device thereto are mounted. There can be also another specification which involves, instead of the canopy 12, a cabin in which the seat stand 10 and the operator's seat 11 are provided, namely, a cabin specification.

Figure 1:
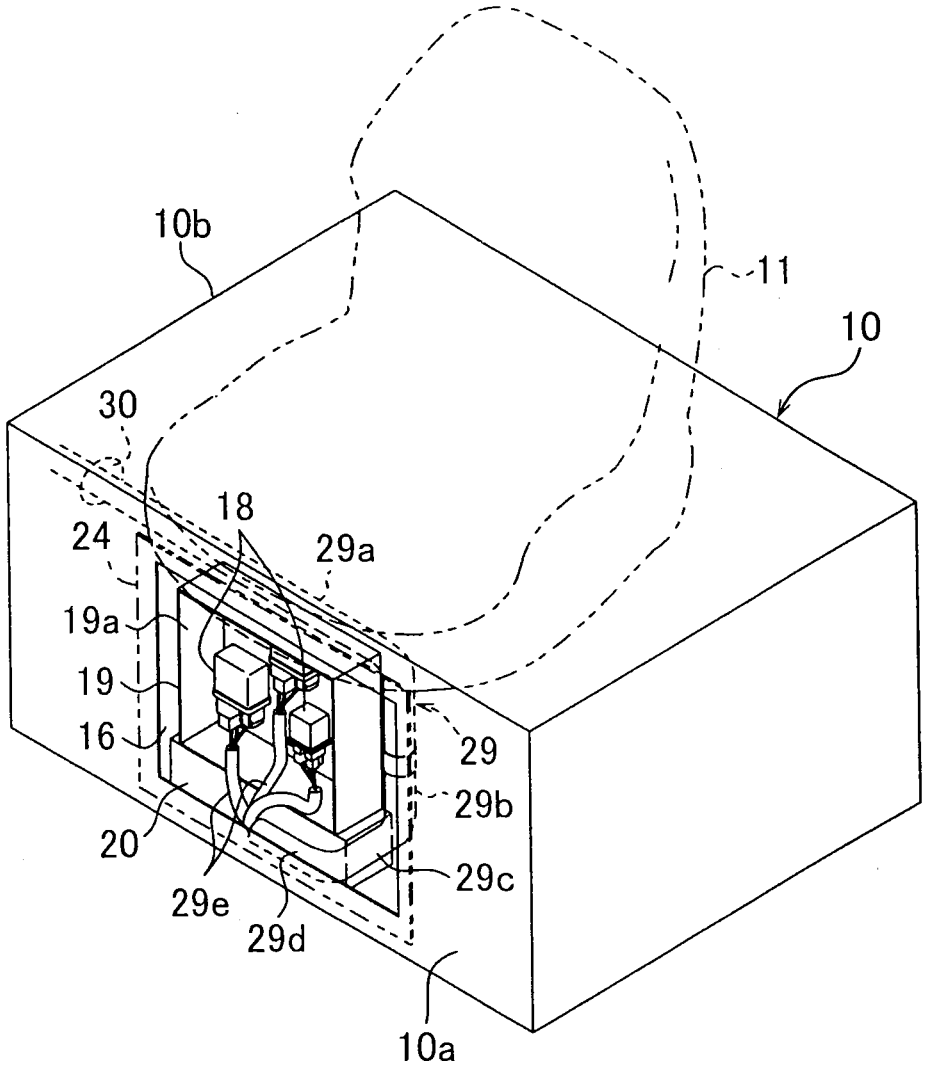
FIG. 1 is a perspective view showing an important part of a small-sized excavator according to an embodiment of the present invention.
Figure 2:
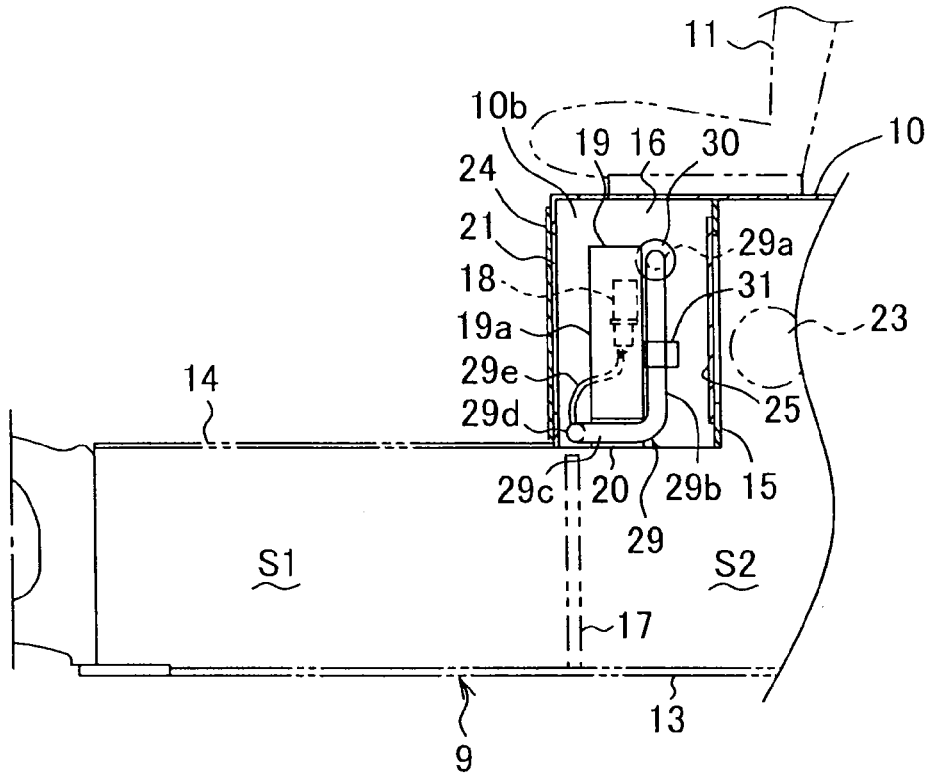
FIG. 2 is a cross-sectional side view of the important part.

As shown in FIG. 2, the upper frame 9 includes a bottom plate 13 and a floor plate 14 arranged above the bottom plate 13 at a vertical interval. Between the bottom plate 13 and the floor plate 14 is defined an underfloor space S1, in which a control valve unit and the like are installed.

The seat stand 10 is mounted on the upper frame 9, rearward of the floor plate 14, to define an under-seat space S2 under the operator's seat 11 and between the seat stand 10 and the bottom plate 13 of the upper frame 9.

The upper slewing body 2 further includes a partition wall 15 and a separation wall 17. The partition wall 15 is vertically provided in an upper portion of the under-seat space S2 to define a front space 16 which is a front portion of the under-seat space S2 and is above the floor plate 14. The space which is a part of the under-seat space S2 other than the front space 16 constitutes an engine room. The separation wall 17 is vertically provided to partition a lower portion of the under-seat space S2 and the underfloor space S1 positioned forward of the under-seat space S2.

Figure 3:
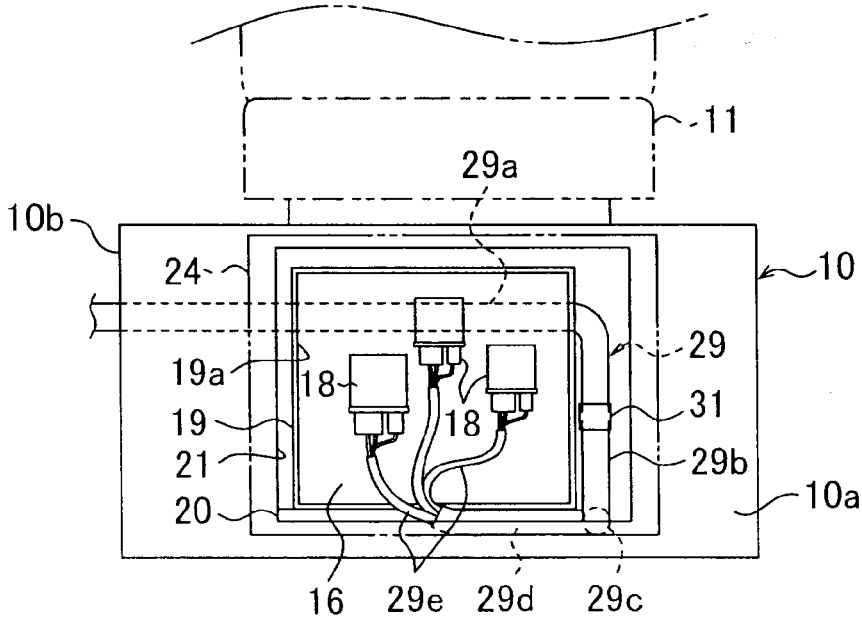
FIG. 3 is a front view of the important part.
Figure 4:
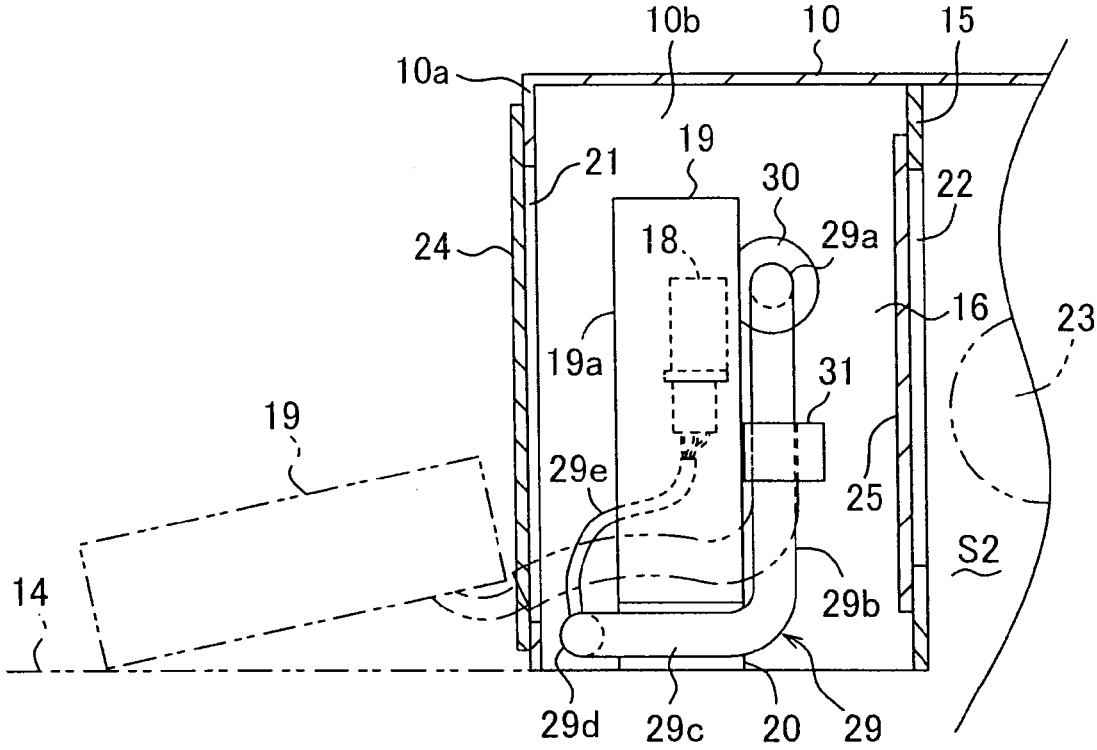
FIG. 4 is an enlarged view of a part of FIG. 2 which part shows the inside of a front space.
Figure 5:
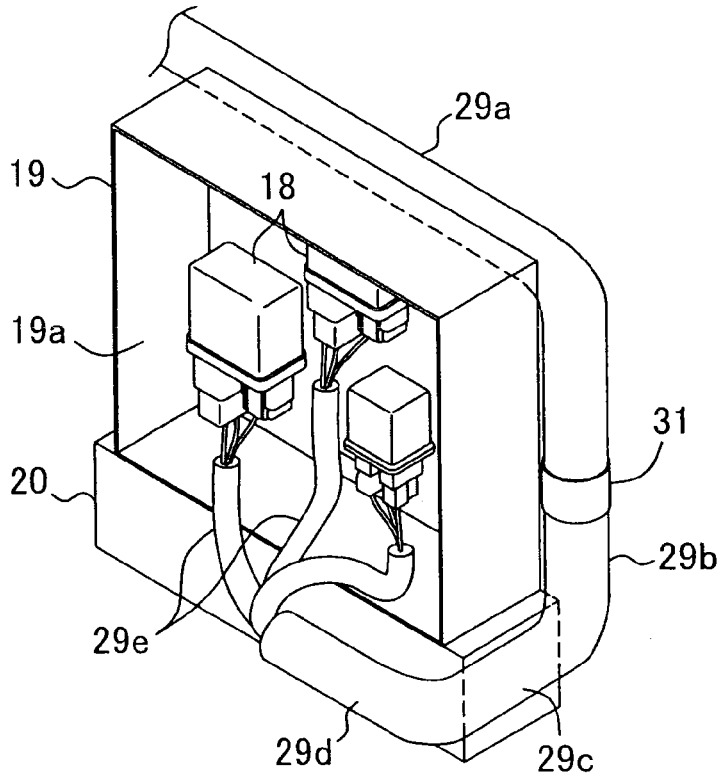
FIG. 5 is a perspective view of an electric-component box shown in FIG. 4 and a harness connected to the electric-component box.

The excavator further includes an electric-component box 19 and a box stand 20 which are accommodated in the front space 16. The electric-component box 19 accommodates a lot of electric components 18 including a relay. For simplification of drawing, shown in FIG. 2 and FIG. 4 is only one electric component 18, and shown in FIG. 3 are only three electric components 18. The electric-component box 19, placed on the box stand 20, is installed vertically and detachable by means of bolting or the like.

The electric-component box 19 is a rectangular parallelepiped-like box, having a box-opening 19*a* opened forward. The seat stand 10 includes a front wall 10*a* formed with a front opening 21 overlapping the box opening 19*a*, the openings 21 and 19*a* allowing respective works for attachment and wiring of the electric components 18 to be performed at a front side of the seat stand 10 through the openings 21 and 19*a*.

The partition wall 15 has a rear opening 22 bringing respective spaces forward and rearward of the partition wall 15 into communication with each other, the rear opening 22 allowing maintenance work on some devices 23 rearward of the front space 16 of the under-seat space S2, such as an alternator and a stator motor, to be positioned.

The excavator further includes a front cover 24 which closes the front opening 21 at a front side of the rear opening 21 and a rear cover 25 which closes the rear opening 21 at a front side of the rear opening 22. The covers 24 and 25 are detachably attached to the seat stand 10 and the partition wall 15, respectively, with bolts or the like not shown in the drawings. FIG. 3 shows a state where the front cover 24 has been detached.

The excavator further includes a harness 29. The harness 29 is a wire bundle for interconnecting the electric components 18 in the electric-component box 19 and external devices outside the electric-component box 19, for example, a relay and a controller for controlling the relay.

The harness 29 according to the embodiment is introduced into the front space 16 through a wiring port 30 formed in a sidewall of the seat stand 10 at a rear side of the electric-component box 19, for example, in a right sidewall 10*b*. The harness 29 has a region to be located inside the front space 16, the region including an upper horizontal portion 29*a*, a downward-extending portion 29*b*, a lower forward-extending portion 29*c*, an interconnection portion 29*d*, and an upward-extending portion 29*e*. The upper horizontal portion 29*a* extends horizontally, at a rear side of an upper portion of the electric-component box 19, from the wiring port 30 to an end of the electric-component box 19 on opposite side to the wiring port 30, that is, on a left side. The downward-extending portion 29*b* extends downward from a left end of the upper horizontal portion 29*a*, i.e., from a position having a height equivalent to that of the wiring port 30, along the electric-component box 19. The lower forward-extending portion 29*c* extends forward from a lower end of the downward-extending portion 29*b* toward a front surface of the electric-component box 19. The interconnection portion 29*d* extends horizontally from the lower end of the downward-extending portion 29*b* along a lower portion of the front surface of the electric-component box 19 so as to return toward a right side, that is, toward the wiring-port-30 side, reaching an approximately laterally central portion of the electric-component box 19. The upward-extending portion 29*e* extends upward from an end of the interconnection portion 29*d*, i.e., from a first height position having a height equivalent to that of the lower end of the downward-extending portion 29*b*, to a second height position where the upward-extending portion 29*e* reaches respective electric components 18 in the electric-component box 19 to be connected to them. Each of the electric components 18 has a connection port and is oriented downward in the electric-component box 19 so as to make a surface in which the connection port is located be a lower surface. The harness 29 is fixed to a not-graphically-shown harness fixing member hold by a clip 31 holding, for example, an intermediate portion of the downward-extending portion 29*b*.

The harness 29 is routed in a devious path including the downward-extending portion 29*b* and the upward-extending portion 29*e*, the devious path having a routing path far longer than that of the shortest path from the wiring port 30 to each of the electric components 18 to give sufficient allowance to a region of the harness 29 from the portion held by the clip 31 to the electric component 18. The allowance is enough to allow the electric-component box 19 to be removed, while keeping connection with the harness 29, to a position where the electric-component box 19 does not hinder a maintenance work for a maintenance-requirement device 23 when the maintenance work is performed: for example, the allowance allows the electric-component box 19 to be pulled out downward from the front space 16 as shown in FIG. 4.

Moreover, in the harness 29 according to the embodiment, the lower forward-facing portion 29*c* and the interconnection portion 29*d* are interposed between the downward-extending portion 29*b* and the upward-extending portion 29*e*, thus increasing the length of the free region from the portion held by the clip 31 to the electric component 18 to thereby increase the allowance; this increases the range of the removal of the electric-component box 19. In other words, the routing path of the region of the harness 29 beyond the clip fixed portion is set so as to generate the allowance enough to allow the electric-component box 19 to be removed as described above. This enables the efficiency of the maintenance work to be markedly enhanced compared to a case where the harness 29 is required to be temporarily disconnected from the electric components 18 for the maintenance work.

Furthermore, even if water has infiltrated into the front space 16, the upward-extending portion 29*e* of the harness 29 can preclude the water from running on the harness 29 to reach the electric components 18, thereby protecting the electric components 18 from malfunctioning or failure due to contact with water.

The present invention is not limited to the above-described embodiment. The present invention includes, for example, the following embodiments.

(1) The lower forward-facing portion 29*c* of the harness 29 can be omitted. For example, the harness 29 may be routed such that the upper horizontal portion 29*a* extends along a front portion of an upper surface of the electric-component box 19 and the downward-extending portion 29*b* of the harness 29 extends downward from a distal end of the upper horizontal portion 29*a* to directly reach the interconnection portion 29*d*. The thus routed harness 29 also can allow the electric-component box 19 to be removed to a position where the electric-component box 19 does not hinder the maintenance work for the maintenance-requirement device 23. Alternatively, the upper horizontal portion 29*a* of the harness 29 can be omitted. For example, it is also permitted that the downward-extending portion 29*b* of the harness 29 extends downward directly from the wiring port 30 and the lower forward-facing portion 29*c* extends forward from the lower end of the downward-extending portion 29*b* to be connected to the upward-extending portion 29*e* through a leftward interconnection portion 29*d*.

(2) The present invention is not limited to a canopy-type or cabin-type excavator but is similarly applicable to a medium- or large-sized excavator or any other construction machine having an under-seat space and an electric-component box installed in the front portion of the under-seat space.

As described above, the present invention provides a construction machine including an electric-component box and a harness connected to the electric-component box, the control machine allowing the electric-component box to be easily removed to a position where the electric-component box does not hinder maintenance for a maintenance-requirement device and precluding water from reaching electric components.

Provided by the present invention is a construction machine including: a lower travelling body; an upper slewing body mounted on the lower travelling body so as to be slewable, the upper slewing body including an upper frame including a bottom plate and a floor plate provided above the bottom plate at a vertical interval, a seat stand provided rearward of the floor plate and on the upper frame and defining an under-seat space between the seat stand and the bottom plate of the upper frame, an operator's seat provided on the seat stand, and a partition wall provided in a front portion of the under-seat space to define a front space at a front side of the partition wall; an electric-component box installed in the front space to accommodate an electric component; a maintenance-requirement device requiring maintenance therefor and installed in a space which is included in the under-seat space and located at a rear side of the front space; and a harness for connecting the electric component in the electric-component box to an external device located outside the under-seat space. The seat stand includes a front wall located forward of the front space, the front wall including a front opening which brings an outer space forward of the front wall and the front space rearward of the front wall into communication with each other. The partition wall includes a rear opening which brings the front space forward of the partition wall and the under-seat space rearward of the partition wall into communication with each other. The seat stand includes a wiring port for introducing the harness into the front space through the wiring port. The harness includes a region to be routed in the front space, the region including a downward-extending portion extending downward from a position having a height equivalent to that of the wiring port to a lower portion of the front space and an upward-extending portion extending upward from a first height position having a height equivalent to a height of a lower end of the downward-extending portion to a second height position which allows the harness to be connected to the electric component, the region thus routed in a devious path having a routing length larger than a length of the shortest path from the wiring port to the electric component, the routing length including allowance enough to allow the electric-component box to be removed, while remaining connected to the harness, between a first position where the electric-component box closes the rear opening at a front side of the rear opening and a second position where the electric-component box allows maintenance work for the maintenance-requirement device to be performed through the front opening and the rear opening.

The allowance enables the electric-component box to be removed, while keeping connection with the harness, to a second position where the electric-component box does not hinder the maintenance work for the maintenance-requirement device, for example, a position where the electric-component box is pulled out from the seat stand through the front opening. This enables the efficiency of the maintenance work to be markedly enhanced compared to a case where the harness is required to be temporarily disconnected from the electric components for the maintenance work. In other words, routing the harness in the devious path enables the harness to have the allowance satisfying the required removal of the electric-component box. Besides, even if water has infiltrated into the front space, the upward-extending portion included in the harness can preclude the water from reaching the electric components, thereby protecting the electric components from malfunctioning or failure due to contact with water.

The harness may further include a portion other than the downward-extending portion and the upward-extending portion. For example, in the case where the downward-extending portion of the harness extends downward at a right or left side of the front space, it is preferable that the harness further includes an interconnection portion extending from the lower end of the downward-extending portion to a laterally intermediate portion of the electric-component box to interconnect the downward-extending portion and the upward-extending portion.

The harness thus including the laterally extending interconnection portion interposed between the downward-extending portion and the upward-extending portion can be routed in a devious path capable of generating a large allowance with no difficulty, compared to, for example, a harness in which the upward-extending portion is joined directly to the lower end of the downward-extending portion, that is, a harness having substantially no interconnection portion. This enables the range of the removal of the electric-component box to be further increased.

In this case, more preferable is that: the harness further includes an upper horizontal portion extending from the wiring port toward a side laterally opposite to the wiring port; the downward-extending portion extends downward from a distal end of the upper horizontal portion; and the interconnection portion extends from the lower end of the downward-extending portion in a direction of returning laterally toward the wiring port. The combination of the upper horizontal portion and the interconnection portion enables the harness to be routed in a devious path capable of including greater allowance.

This application is based on Japanese Patent application No. 2013-226565 filed in Japan Patent Office on Oct. 31, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a lower travelling body;

an upper slewing body mounted on the lower travelling body so as to be slewable, the upper slewing body including an upper frame including a bottom plate and a floor plate provided above the bottom plate at a vertical interval, a seat stand provided rearward of the floor plate and on the upper frame and defining an under-seat space between the seat stand and the bottom plate of the upper frame, an operator's seat provided on the seat stand, and a partition wall provided in a front portion of the under-seat space to define a front space at a front side of the partition wall;

an electric-component box installed in the front space and accommodating an electric component;

a maintenance-requirement device requiring maintenance therefor and installed in a space which is included in the under-seat space and located at a rear side of the front space; and a harness for connecting the electric component in the electric-component box to an external device located outside the under-seat space, wherein:

the seat stand includes a front wall located forward of the front space, the front wall including a front opening which brings an outer space forward of the front wall and the front space rearward of the front wall into communication with each other;

the partition wall includes a rear opening which brings the front space forward of the partition wall and the underseat space rearward of the partition wall into communication with each other;

the seat stand includes a wiring port for introducing the harness into the front space through the wiring port;

the harness includes a region to be routed in the front space, the region including a downward-extending portion extending downward from a position having a height equivalent to a height of the wiring port to a lower portion of the front space and an upward-extending portion extending upward from a first height position having a height equivalent to a height of a lower end of the downward-extending portion to a second height position which allows the harness to be connected to the electric component, the region thus routed in a devious path having a routing length larger than a length of the shortest path from the wiring port to the electric component, the routing length including allowance enough to allow the electric-component box to be removed, while remaining connected to the harness, between a first position where the electric-component box closes the rear opening at a front side of the rear opening and a second position where the electric-component box allows maintenance work for the maintenance-requirement device to be performed through the front opening and the rear opening, wherein:

the downward-extending portion of the harness extends downward at a right or left side of the front space, and the harness further includes an interconnection portion extending from the lower end of the downward-extending portion to a laterally intermediate portion of the electric-component box to interconnect the downward-extending portion and the upward-extending portion, and the harness further includes an upper horizontal portion extending from the wiring port toward a side laterally opposite to the wiring port; the downward-extending portion extends downward from a distal end of the upper horizontal portion; and the interconnection portion extends from the lower end of the downward-extending portion in a direction of returning laterally toward the wiring port.

2. The construction machine according to claim 1, wherein the second position is a position where the electric-component box is pulled out from the seat stand through the front opening.

* * * * *